United States Patent [19]

Eriksson

[11] Patent Number: 4,602,674

[45] Date of Patent: Jul. 29, 1986

[54] TWO-CIRCUIT HEAT EXCHANGER

[75] Inventor: Rune Eriksson, Linköping, Sweden

[73] Assignee: AB Elge-Verken, Linköping, Sweden

[21] Appl. No.: 464,001

[22] Filed: Feb. 4, 1983

[30] Foreign Application Priority Data

Feb. 8, 1982 [SE] Sweden ..... 8200707

[51] Int. Cl.[4] ..... F28F 11/00

[52] U.S. Cl. ..... 165/70; 165/168; 165/165

[58] Field of Search ..... 165/70, 134 R, 133, 165/164, 165, 168, 132, 163

[56] References Cited

U.S. PATENT DOCUMENTS

| | | | |
|---|---|---|---|
| 1,791,528 | 2/1931 | Hull | 165/132 X |
| 1,799,081 | 3/1931 | Blomqvist | 165/164 |
| 2,011,201 | 8/1935 | Rosenblad | 165/165 |
| 2,324,707 | 7/1943 | Johnson | 165/164 |
| 2,804,287 | 8/1957 | Huet | 165/165 |
| 3,086,358 | 4/1963 | Tumavicus | 165/164 |
| 3,854,530 | 12/1974 | Jouet et al. | 165/163 |
| 4,287,724 | 9/1981 | Clark | 165/163 X |
| 4,347,895 | 9/1982 | Zambrow | 165/134 R |
| 4,402,359 | 9/1983 | Carnavos et al. | 165/133 X |
| 4,411,307 | 10/1983 | Ecker | 165/164 X |

FOREIGN PATENT DOCUMENTS

| | | | |
|---|---|---|---|
| 2638492 | 3/1977 | Fed. Rep. of Germany | 165/164 |
| 1332607 | 6/1963 | France | 165/164 |
| 1313154 | 4/1973 | United Kingdom | 165/164 |
| 1437460 | 5/1976 | United Kingdom | 165/164 |
| 2045915 | 11/1980 | United Kingdom | 165/164 |

*Primary Examiner*—Albert W. Davis Jr.
*Assistant Examiner*—Peggy A. Neils
*Attorney, Agent, or Firm*—Watson, Cole, Grindle & Watson

[57] ABSTRACT

A two-circuit heat exchanger is characterized in that the heat exchange tube(s) of each circuit is/are formed with non-circular cross-section to exhibit at least partially plane side surfaces, said side surfaces of the tubes in the two circuits being in heat-exchange relationship with one another.

9 Claims, 13 Drawing Figures

TWO-CIRCUIT HEAT EXCHANGER

TECHNICAL FIELD

The present invention relates to a two-circuit heat exchanger, consisting of two thermally-linked circuits of tubes.

In heat exchangers, for example for district heating systems with district heating water under higher pressure, for example 5–20 bar, in the primary circuit, and tapwater under lower pressure in the secondary circuit, high security against leakage from the district heating system to the hot tapwater circuit is required. The district heating water circuit normally operates under a higher pressure than the hot tapwater circuit, and a leakage in a heat exchanger of the system may lead to district heating water leaking into the hot tapwater circuit, which is undesirable, not least for health reasons. At the same time it is desirable to employ a heat exchanger which is simple to construct and which has a high thermal efficiency.

DISCUSSION OF PRIOR ART

Known in the art are, among other things, three-circuit heat exchangers which employ two systems of spiral tubes of circular cross-section and an additional circuit surrounding these tubes, i.e., a relatively complicated arrangement. The main purpose of this type of three-circuit heat exchanger is for the accumulation of heat.

SUMMARY OF THE INVENTION

One object of this invention is to provide a simplified type of two-circuit heat exchanger, by which the above-mentioned problems are solved. A heat exchanger according to the invention is characterized in that each circuit is formed from at least one heat-exchange tube of non-circular cross-section exhibiting at least partially plane side surfaces, the side surfaces of the heat-exchange tubes in the two circuits being in thermal contact one with the other.

This results in a compact heat exchanger with good thermal efficiency. The risk of water leaking between circuits can be reduced and any water leakage that might occur can be easily and rapidly indicated.

In a preferred embodiment, the heat-exchange tubes of the two circuits are shaped by a flattening operation performed on tubes of circular cross-section, e.g., by pressing between two plates, and each tube circuit in the heat exchanger is formed as at least one flat or pancake spiral.

During flattening, the heat-exchange tubes can be subjected to a high internal pressure (for example 50 bar), whereby internal indentations and "constrictions" are substantially eliminated, and fins or cusps can be formed over unsupported regions of the otherwise plane side surfaces.

A heat exchanger according to the invention is easily assembled and has a high thermal efficiency, among other things because of the high coefficients of heat transfer between heat-exchange tubes of the two circuits. The $\alpha$-values can be further increased by forming the tubes with an uneven surface in the longitudinal direction thereof during their flattening.

BRIEF DESCRIPTION OF DRAWINGS

The invention will be exemplified in greater detail, by way of example, with reference to the accompanying drawings, of which.

DESCRIPTION OF PREFERRED EMBODIMENTS

Figure 1A:
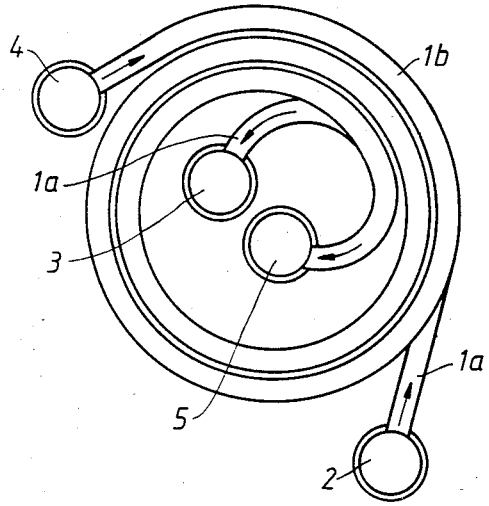
FIGS. 1A and 2 are schematic representations, in plan, of two simple embodiments of two-circuit heat exchangers in accordance with the invention, which show just the principle of construction but no details thereof.

FIG. 1A shows a very simple heat exchanger with two circuits. A first circuit for district heating water employs a spiral heat exchange tube 1a extending from a feed pipe 2 to a feed pipe 3, and a second circuit for clean tapwater employing a spiral heat exchange tube **1*b* extending from a feed pipe 4 to a feed pipe 5. The directions of water flow in the two circuits are mutually oppositely directed, and the tubes 1*a*, 1*b*** are in thermal contact over major portions of their lengths.

Figure 1B:
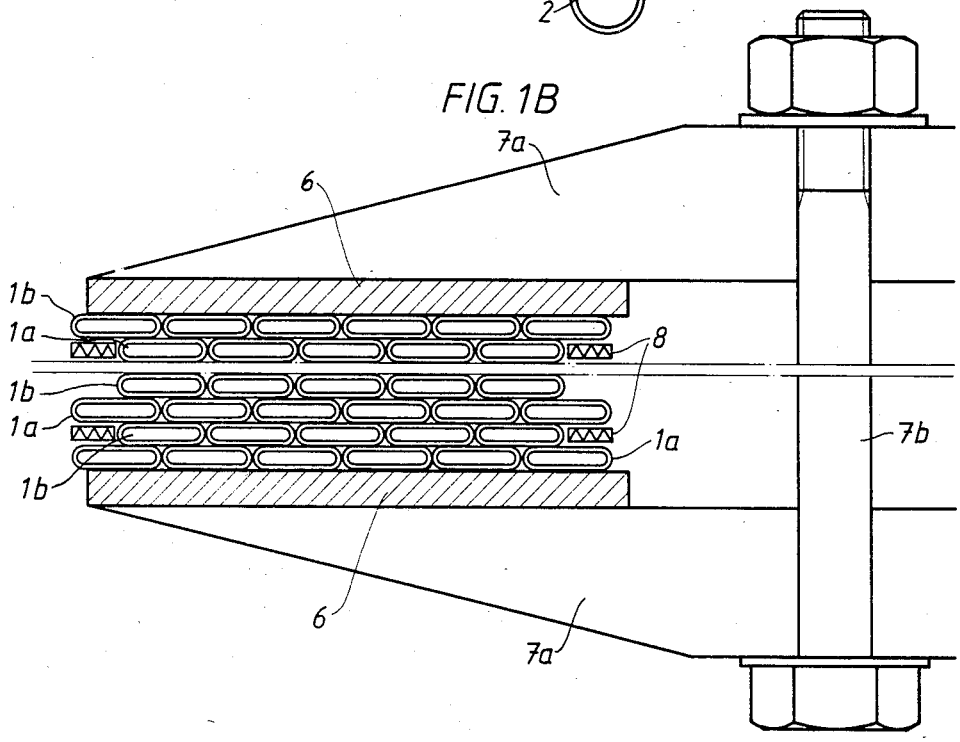
FIG. 1B is a radial sectional view through the spiral tube cluster of a first practical embodiment of a two-circuit heat exchanger in accordance with the invention.

FIG. 1B is a radial section through a two-circuit heat exchanger and shows the closely packed arrangement of flattened tubes of the same type as those shown in FIG. 1A, the flattened tubes, however, having more windings than those shown in FIG. 1A. The tubes **1*a* and 1*b* are interleaved in spiral layers and are clamped and mounted between plates 6 which are clamped around the tube cluster by jaws 7*a* and clamping bolts 7*b* (only one of which is shown). Annular support members 8** are also arranged adjacent to some of the flat coils of tubes to improve the stability of the cluster.

Figure 2:
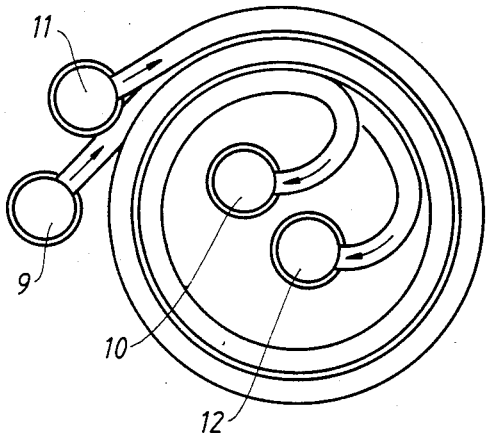

FIG. 2 shows a heat exchanger with two flat spirals, but in distinction to the arrangement shown in FIG. 1A, the spirals are both wound in the same direction. The two circuits shown in FIG. 2 pass between feed pipes 9, 10 and 11, 12, respectively.

Figure 3:
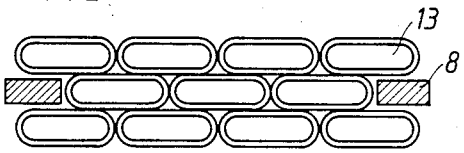
FIG. 3 shows part of the tube cluster of a heat exchanger using simple flattened tubes.

FIG. 3 shows the arrangement of the tube cluster of FIG. 1B on a slightly larger scale, with flattened tubes 13 and supports 8, the uppermost and lowermost layers being series-connected and forming parts of one circuit, while the middle layer belongs to the other circuit.

Figure 6:
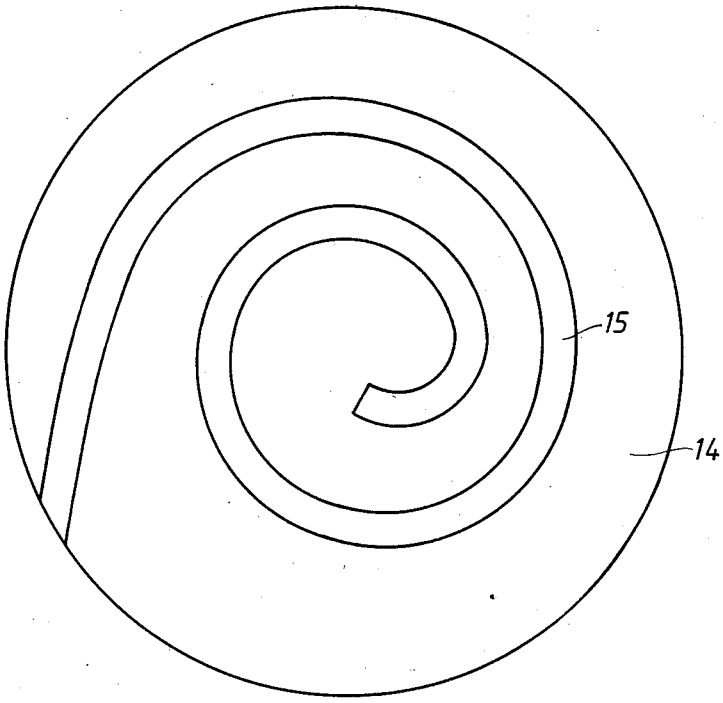
FIG. 6 shows, in plan, a press plate suitable for a flattening operation on a simple tube spiral.
Figure 7A:
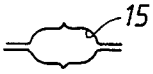
FIGS. 7A, 7B and 7C show alternative shapes for the cross-section of grooves employed in press plates such as that shown in FIG. 6.
Figure 7B:
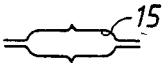
Figure 7C:
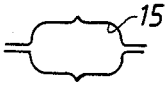

Flattening of circular cross-section tubes to form the tubes 13 of FIG. 3 can take place between two plates (one of which is shown in plan at 14 in FIG. 6) and may be performed by externally compressing one spiral at a time. A spiral groove 15 is formed in each plate 14, and this spiral has a cross-section representing one half of the desired final cross-section required for the tube after flattening. Typical sections which could be employed are shown in FIGS. 7A, 7B and 7C.

Figure 6A:
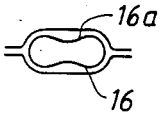
FIGS. 6A and 6B are schematic indications of successive stages in the flattening operation on tubes for a heat exchanger in accordance with the invention.
Figure 6B:
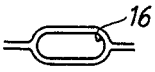

The initial stage in the flattening of a circular cross-section tube may, for example, result in a "constriction" or indentation 16a in a tube 16 (see FIG. 6A), but this can easily be removed by pressurizing the interior of the tube 16 with a pressure medium, for example at 50 bar, whereby the indentations 16a are pressed out. If the groove shape is as shown in FIGS. 7A, 7B or 7C, pressurizing the tube will form an uneven surface e.g., a fin or cusp 17 to appear in the otherwise plane side surfaces 18 of the tube sections such fins or cusps 17 can be on just one or on both sides of the tube.

Figure 4:
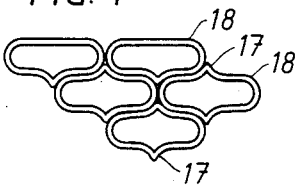
FIGS. 4 and 5 show parts of tube clusters similar to FIG. 3 but with tubes of more complicated shape, to show a more closely packed arrangement.

FIG. 4 shows how pancake spirals can be applied, one on top of the other, the tube centers in adjacent layers being mutually displaced. The fins 17 then locate in the nip between adjacent tube revolutions in the next adjacent spiral, in the manner shown in FIG. 4.

It is possible to shape the groove 15 in each plate 14 so that the cross-section of the tube changes somewhat along its length. Providing varying transverse profiles in the longitudinal direction of the tubes, can improve the heat transfer coefficient of the heat exchanger (i.e., the $\alpha$-value is increased).

The number of series-connected pancake spirals employed in both the primary and secondary circuits can vary depending on the heat transfer conditions pertaining, as can the number of revolutions in each spiral.

Figure 8:
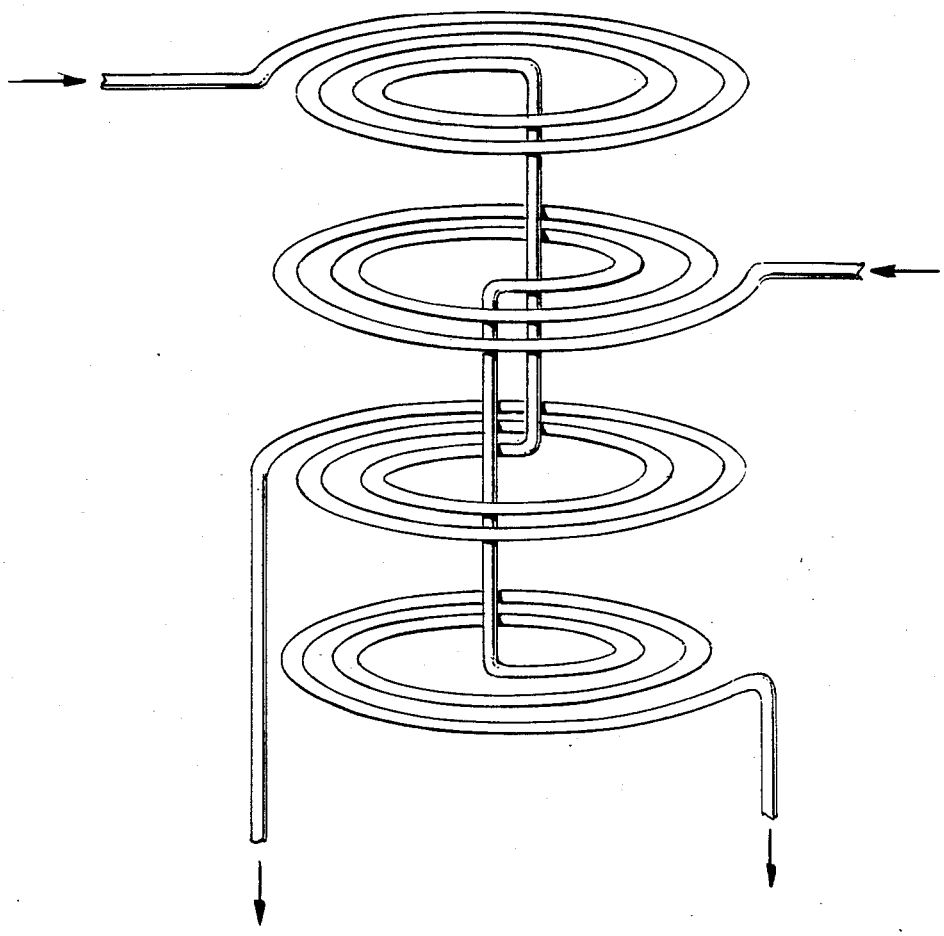
FIG. 8 shows a schematic exploded view of an embodiment of the inventive heat exchanger wherein the two fluid circulation systems therein comprise series-connected planar spirals.

FIG. 8 shows an exploded view of two series-connected planar spirals in each of the two circuits.

Desirably, the surfaces 18 are formed so that the best possible mechanical contact is obtained with the adjacent spiral(s), i.e., between the revolutions of tubes in the different spirals/systems. Each spiral is shaped according to the design of the press tool 14, and is designed to withstand the acticipated working pressures and test pressures.

Figure 5:
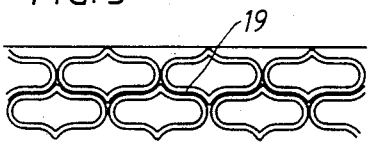

A water soluble film 19 (see FIG. 5) can be applied between adjacent spirals. Prior to the possible dissolution of the film 19 (upon leakage), this film enhances the heat transfer between the spirals, for example by bridging between surfaces which do not make direct contact with each other.

In the event of leakage from one or both circuits, water enters between the spirals, whereby the film 19 is dissolved to give an indication of the leakage either by appearance of the film material in the leakage water or by a reduction in heat exchange efficiency.

When the tube cluster of the heat exchanger has been assembled it can be subjected to a high internal pressure, for example, 100 bar, in both the primary and the secondary circuits in order to ensure intimate contact between the contact surfaces. Every alternate coil may be made from a different material, e.g., to encourage deformation during this pressure forming stage.

An indication of leakage can be arranged to take place electrically, for example, by means of contact and/or resistance wires located in the tube array and/or by means of drip tubes or the like (not shown) disposed within the tube array and leading to a visible collecting vessel.

The tubes may, for example, be of copper, bronze, a copper alloy, sheet metal, steel or plastic materials, and the thickness of the tube walls may be, for example, between 0.5–0.7 mm. The diameter of the tubes might be 10 mm. The press plate 14 may, for example, have a diameter of 400 mm.

The invention can be varied in many ways within the scope of the following claims.

What is claimed is:

1. A two-circuit heat exchanger which comprises an elongated first conduit which is coiled in the form of a planar spiral about an imaginary central axis, said first conduit forming at least a portion of a first circuit in said heat exchanger and having an elongated cross section and opposite longer sides and opposite shorter sides, said opposite longer sides including at least one portion which is generally planar, each of said generally planar portions being substantially perpendicularly oriented with respect to said imaginary central axis, a separate elongated second conduit which is coiled in the form of a planar spiral about said imaginary central axis, said second conduit forming at least a portion of a second circuit in said heat exchanger and having an elongated cross section and opposite longer sides and opposite shorter sides, said opposite longer sides including at least one portion which is generally planar, each of said generally planar portions of said second circuit being substantially perpendicularly oriented with respect to said imaginary central axis, one of said generally planar portions of at least one of the opposite longer sides of said second conduit being in direct contact with a generally planar portion of one of the opposite longer sides of said first conduit, and first and second supply means respectively connected to said first and second conduits to supply separate fluids thereto.

2. The two-circuit heat exchanger as defined in claim 1, wherein each said planar spiral includes a plurality of revolutions which define nips therebetween, wherein the revolutions of one said planar spiral of one of said two circuits are offset from the revolutions of the adjacent planar spiral of the other of said two circuits, and wherein the longer side of each elongated conduit forming a planar spiral includes a fin which fits in the nip defined between the revolutions of the elongated conduit forming the adjacent planar spiral.

3. The two-circuit heat exchanger as defined in claim 2, wherein the revolutions of the elongated conduit forming one planar spiral of one circuit are offset halfway between the revolutions of the elongated conduit forming the adjacent planar spiral of the other circuit.

4. The two-circuit heat exchanger as defined in claim 2, including a plurality of elongated first and second conduits in the form of planar spirals which are connected in series to provide said first and second circuits, the planar spirals formed by said first conduits of said first circuit alternating with the planar spirals formed by said second conduits of said second circuit along said imaginary central axis.

5. The two-circuit heat exchanger as defined in claim 4, wherein said heat exchanger includes two plates which hold the elongated conduits forming the alternating planar spirals of said first and second circuits together.

6. The two-circuit heat exchanger as defined in claim 5, wherein said two plates are respectively supported by the opposing jaws of a clamping device.

7. The two-circuit heat exchanger as defined in claim 1, wherein a water-soluble film is located between the facing longer sides of said elongated first and second conduits forming said planar spirals of said first and second circuits.

8. The two-circuit heat exchanger as defined in claim 1, wherein the facing longer sides of said elongated first and second conduits forming said planar spirals of said first and second circuits are uneven, so as to improve the coefficient of heat transfer from each planar spiral of one circuit to the other.

9. The two-circuit heat exchanger as defined in claim 1, wherein said first and second conduits forming said planar spirals of said first and second circuits are mounted so as to be generally horizontally oriented, one above the other.

* * * * *